US007244177B2

(12) United States Patent
Abe

(10) Patent No.: US 7,244,177 B2
(45) Date of Patent: Jul. 17, 2007

(54) VARIABLE VOLUME STORAGE MEMBER FOR A COIN DISPENSING APPARATUS

(75) Inventor: Hiroshi Abe, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 159 days.

(21) Appl. No.: 10/784,578

(22) Filed: Feb. 23, 2004

(65) Prior Publication Data

US 2004/0176020 A1 Sep. 9, 2004

(30) Foreign Application Priority Data

Feb. 25, 2003 (JP) ..... 2003-048093

(51) Int. Cl.
*G07D 1/00* (2006.01)

(52) U.S. Cl. ..... 453/18

(58) Field of Classification Search ..... 221/64, 221/174, 178, 179, 180; 194/350, 353; 453/1, 453/2, 16–18, 49, 63
See application file for complete search history.

(56) References Cited

U.S. PATENT DOCUMENTS 1,962,018 A * 6/1934 Kenkel ..... 221/174
3,902,511 A * 9/1975 Jacobs ..... 453/32
4,469,709 A * 9/1984 Schrauf ..... 426/231
5,017,176 A * 5/1991 Swierczek ..... 453/49
5,064,404 A * 11/1991 Champion ..... 453/17
5,190,495 A 3/1993 Taxon
5,326,312 A * 7/1994 Patroni ..... 453/57
5,423,455 A * 6/1995 Ricciardi et al. ..... 222/1
5,462,010 A * 10/1995 Takano et al. ..... 117/14
6,656,033 B2 12/2003 Abe et al.

FOREIGN PATENT DOCUMENTS

JP 6-43767 6/1994
JP 2002-117428 4/2002

* cited by examiner

*Primary Examiner*—Patrick Mackey
*Assistant Examiner*—Mark J. Beauchaine

(57) ABSTRACT

An improved coin hopper that can be provided as original equipment or as a conversion member for a coin dispensing apparatus is provided. The coin hopper includes a housing member having a cavity for storing coins when mounted in a coin dispensing apparatus and a movable member operatively connected to the cavity of the housing member for increasing and decreasing the storage volume available for coins in the housing member. One or more movable members can exist about a storage bowl. An actuator unit can be activated by a detector unit responsive to the number of coins in the bowl to move the auxiliary movable members into a coin release position. Alternatively, a spring-biased actuator unit can be used for automatically moving the movable member for storing and releasing coins.

20 Claims, 7 Drawing Sheets

VARIABLE VOLUME STORAGE MEMBER FOR A COIN DISPENSING APPARATUS

BACKGROUND OF THE INVENTION

1. Field of the Invention

The present invention is directed to coin dispensing devices which can selectively dispense coins that have been stored in bulk such as in a vending machine, a coin exchanging machine or a gaming machine, and more especially, to a coin storage member which can selectively increase the available storage volume of the storage member within the traditional space confines of coin storage members.

2. Description of Related Art

Various forms of coin dispensing apparatus have been known for a considerable period of time. This industry has had a number of different engineers and technicians attempting to improve the apparatus for receiving, storing and dispensing coins, tokens, metals, medallions, etc. As utilized in the present specification, the term "coin" is used generically not only as a monetary member, but to also include other objects representative of value. Generally, the coins are stored in bulk and are selectively dispensed, depending upon the particular vending machine in which the coin dispenser is installed. For example, coin dispensers can be utilized in arcade machines, gaming machines, currency exchange machines, various types of kiosks, and bus and subway token dispensers.

Examples of coin dispensing devices and coin hoppers can be seen in Japanese Laid-open Utility Patent Model No. 6-43767, U.S. Pat. No. 6,656,033, U.S. Pat. No. 6,588,749, and U.S. Pat. No. 5,190,495. Thus, it has been known to utilize storage hoppers that can have one or more concentric or offset chambers for moving coins between one chamber and another. There have been also auxiliary storage units located adjacent or under a storing bowl that can transmit separately stored coins to a primary storage bowl when the number of coins decrease within the primary storage bowl. A lifting unit can transport the separately stored coins to the primary storing bowl, as seen in Japanese Laid-open Patent Application No. 2002-117428. Thus, the prior art has attempted to provide various configurations for increasing the storage capacity for coins while the industry has also been demanding relatively compact coin dispensers without sacrificing storage capacity. Frequently the coin bowls or hoppers can have their axes tilted to the horizontal support surface and the exterior space surrounding the coin hopper is not utilized. Attempts to provide additional or auxiliary storing bowls or hoppers many times require a gravity feed. The auxiliary bowl frequently is located at a higher position than the primary storing bowl so that the overall height of the storage hopper is increased in size. Alternatively, the arrangements that provide the coins stored beneath or adjacent the primary storing bowl require motor activated devices to lift or move the coins so that they can be deposited in the primary storage hopper and to be accessible to a coin storage selector unit.

There is still a need in this art to optimize the storage capacity of a coin dispensing apparatus in an economical and an efficient manner.

SUMMARY OF THE INVENTION

The present invention provides an improved coin dispensing apparatus having a storage member that can provide auxiliary stored coins to a coin selection unit for selectively dispensing coins in a primary storage member or hopper. A movable member is operatively connected to the storage member for selectively increasing the coin storage volume of the storage member when, for example, extended or moved in a first direction to receive coins for storage. The movable member can be moved in a second direction to release the stored coins to the coin selector unit.

The storage member or hopper can be provided as original equipment in a coin dispensing apparatus or can be provided as a retrofit replacement part of a storage hopper for a coin installation dispensing apparatus that is already in use. The storing bowl or hopper has a cavity for storing coins when mounted in a dispensing apparatus and a movable wall section member is operatively connected to the storing bowl for increasing and decreasing the storage volume. The movable member can be provided in different configurations, including a wedge-shape pocket or bucket member that can rotate in or out of the primary storage hopper and an elastically deformable portion of a side wall of the hopper. An actuator unit can selectively control the position of the bucket member in response to monitoring the volume level of coins located above the coin selector unit. Alternatively, a perimeter wall portion of the primary storage hopper can be flexible and can be expanded or contracted to increase or decrease an auxiliary storage space. Generally in the expanded storage volume, the coins will not be fed by gravity to the coin selector unit. When the auxiliary storage space is contracted, however, the coins are then released for a gravity feed to the coin selector unit. A plurality of movable wall sections can be provided so that the optimum use of previous dead space adjacent the primary storage bowl can be utilized.

Separate actuator units or motors can be used to drive the movable wall member or, alternatively, a principal motor for driving the coin selector unit can also be utilized, for example, through a one-way clutch and a gear transmission assembly for controlling movement of a movable wall member when driven to rotate in an opposite direction from its normal operation in driving the coin selector unit. A detector unit can monitor the amount of stored coins and activate the actuator units. Alternatively a spring driven movable wall member can be used.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
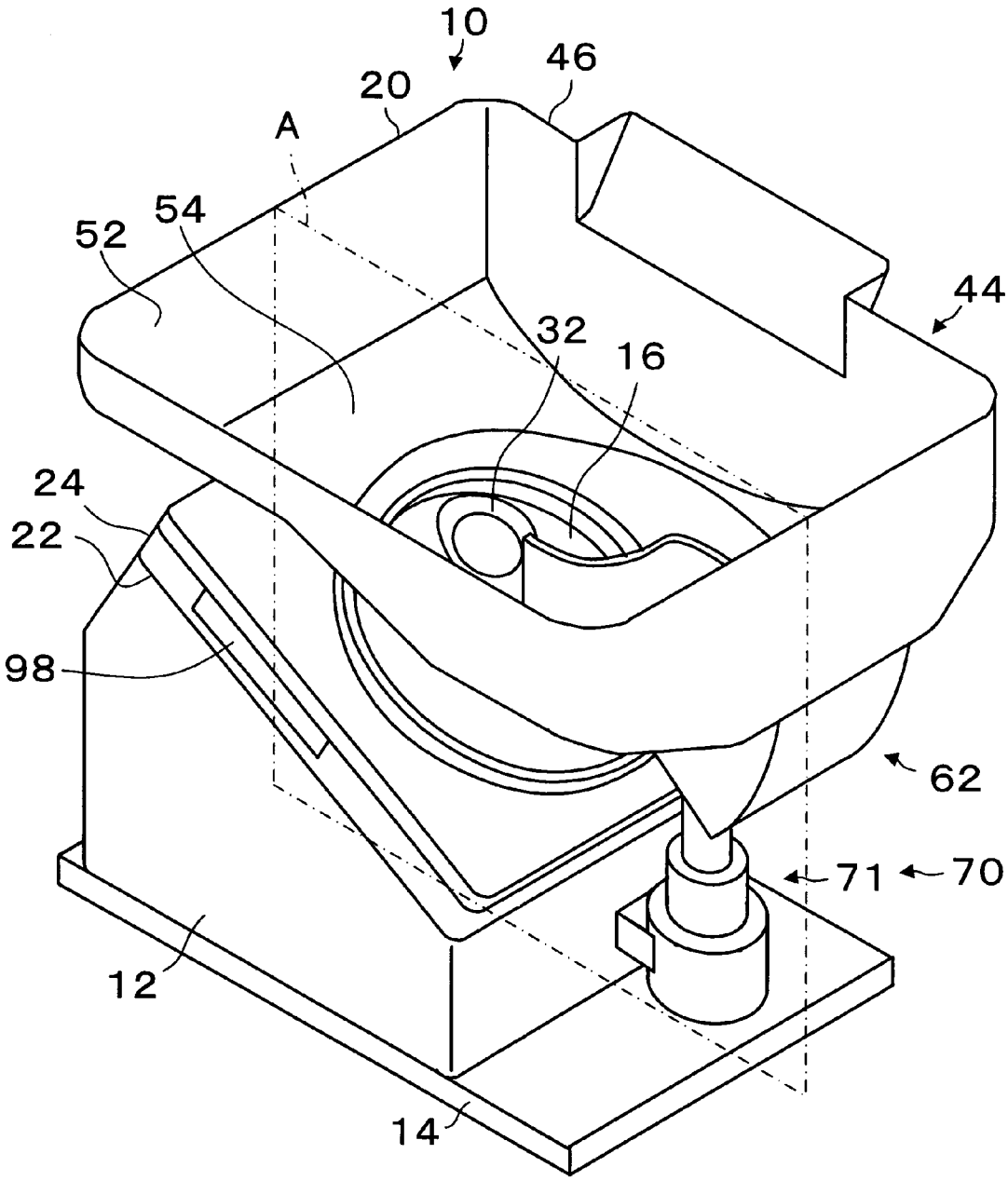
FIG. 1 is a perspective schematic view of a first embodiment of the present invention.

Referring to FIG. 1, a coin hopper having a storing bowl for storing coins in bulk includes a movable wall section. The hopper 10 includes a lower frame 12 mounted on a horizontal base 14. A rotatable coin selector disk 16 can selectively release individual coins from the hopper 10. The storing bowl 20 can have an approximately cylindrical configuration, whereas, shown in FIG. 1, a rectangular configuration with rounded corners can comprise the upper section 44 with an opening rim 46. An aperture 50 is provided at the bottom of the lower inner section 48 to provide as shown in the cross-sectional view of FIG. 2 a cone-shaped configuration that slants with the same orientation as the base plate 24. The lower frame 12 is boxlike in shape with an upper surface 22 that slants approximately at 30 degrees to the surface 22. The base plate 24 is rectangular and is fixed across the upper surface 22. The lower section of the storing bowl 20 is fixed on the base plate 24. A concave circular form opening 26 is located at the center of the base plate 24 and has a flat bottom surface 28 to accommodate the rotating coin selector disk 16.

Figure 2:
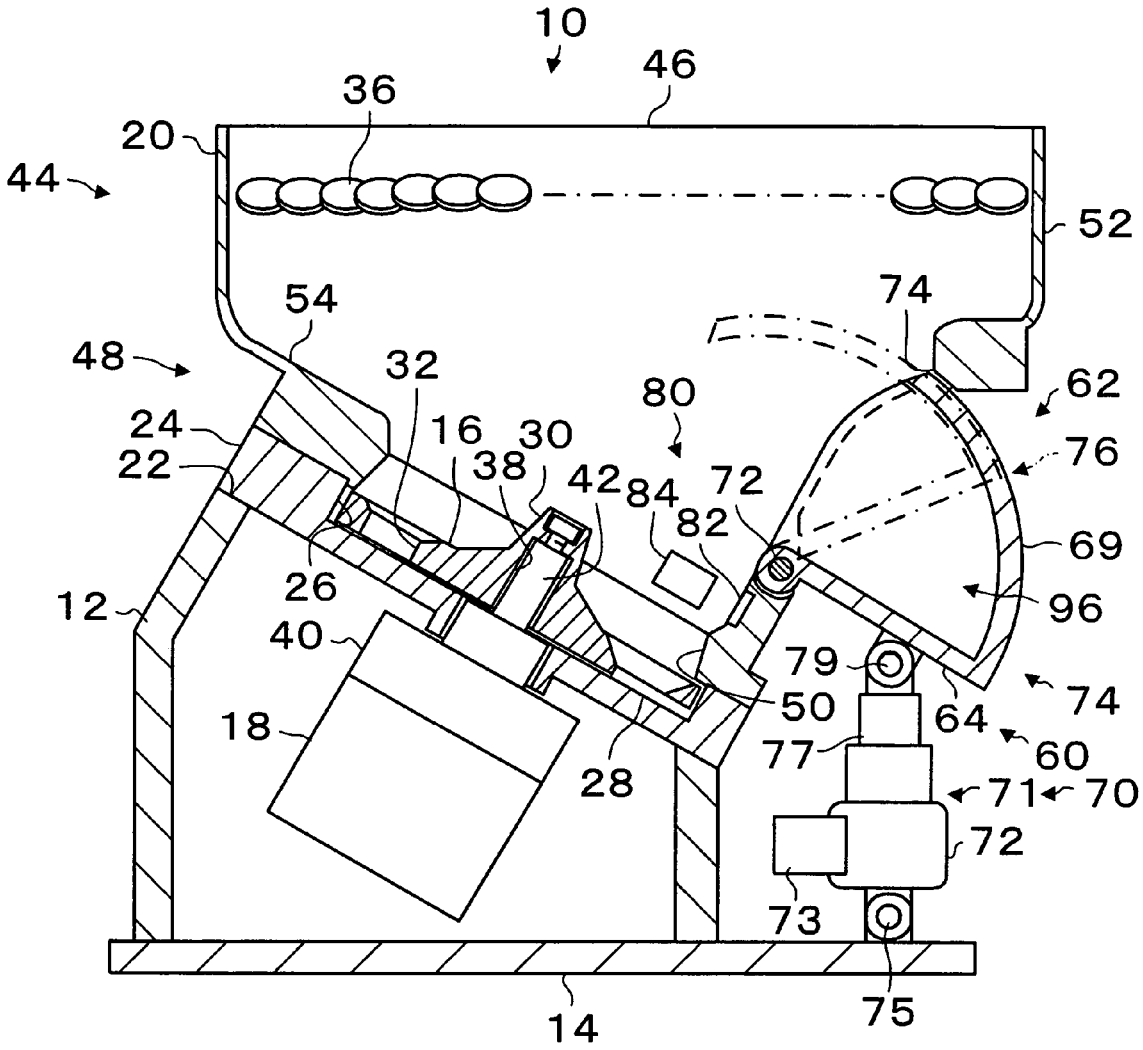
FIG. 2 is a cross-sectional view of plane A shown in FIG. 1.

The rotating coin selector disk 16 is located within the concave opening 26 and has a cone-shaped projection 30 which is located at its center with a plurality of opening holes for receiving coins or disks located at an equal distance from the projection 30. The projection 30 slants downward for directing coins to be received in individual through-holes. Thus, the upper section or upper surface of the rotating coin selector disk 16 having a plurality of through-holes 32 is an inverted cone-shaped structure for directing the disk into the holes. As shown in FIG. 2, the output shaft 42 of a reducer gear system 40 is inserted into a shaft hole 30 of the projection cover 30 of the rotating coin selector disk 16. An electric motor 18 can rotate and drive the rotating coin selector disk 16 through reducer gear system 40.

A friction transmitting unit or clutch member (not shown) is located between the output shaft 42 and the rotating coin selector disk 16. The rotating coin selector disk 16 is driven through the friction transmitting unit by the outputting shaft 42.

The reducer gear system 40 is fixed on the reverse side of the base plate 24 by an attachment structure (not shown). Electric motor 18 is operatively connected to the reducer gear assembly 40 to thereby be able to drive the rotating coin selector disk 16, if the rotating coin selector disk 16 becomes jammed, the friction transmitting unit can release at a predetermined force to prevent the electric motor from burning out by releasing a transmitting force.

Referring to the coin storing bowl 20, the lower end of the storing bowl 20 is fixed on the upper surface of the base plate 24. In this situation, the outlet opening 50 is located over the rotating coin selector disk 16. Therefore, rotating coin selector disk 16 is located at the lower section of the storing bowl in or below the exit opening 50.

Storing bowl 20 includes an upper perpendicular wall section 52 which extends downward from opening 46, and a middle wall section 54 which extends downward towards the rotating coin selector disk 16. Middle wall section 54 slants so that the coins on the middle wall section will slide down towards rotating disk holes 32 by gravity. Perpendicular wall 52 and middle wall 54 form a fixed wall enclosure extending from base plate 24 and cannot move.

Figure 3:
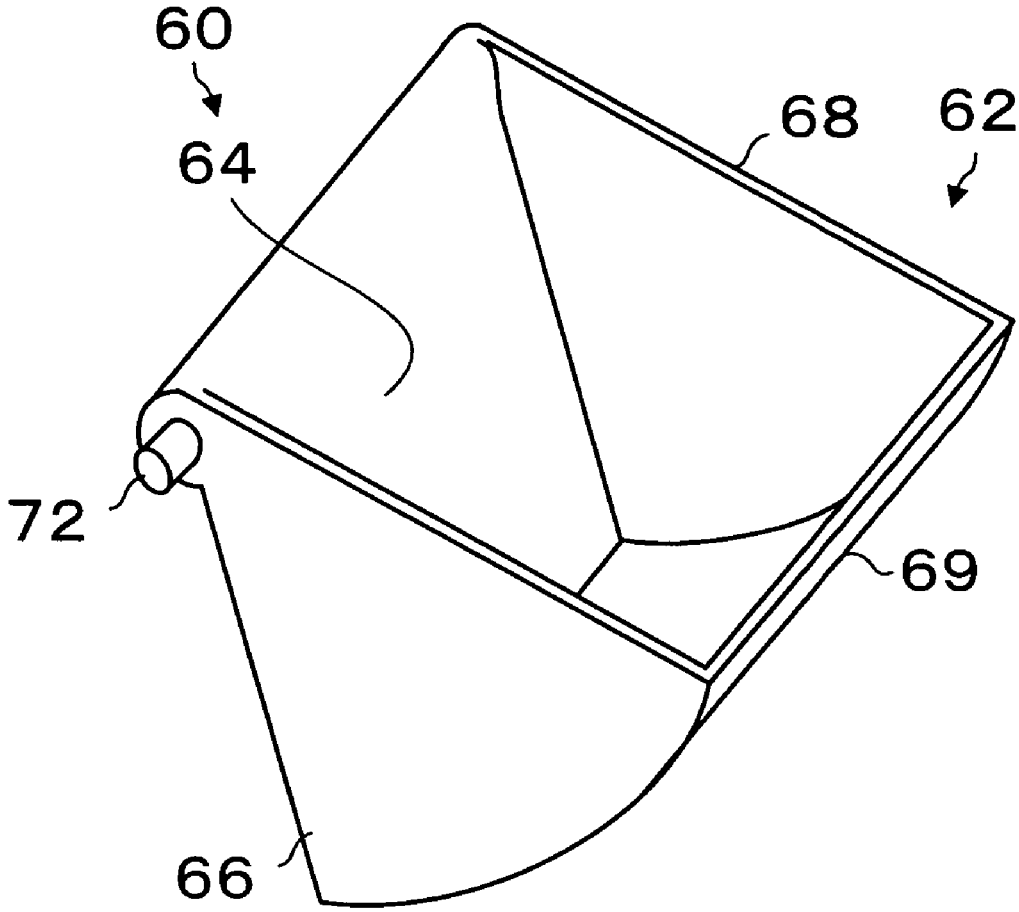
FIG. 3 is a perspective view of the movable storage member of the first embodiment.

A moving wall section 60 can be located at the middle wall 54 or alternatively at the perimeter wall section which is a fixed wall section around the rotating coin selector disk 16. As shown in FIG. 3, moving wall section 60 can be formed as a bucket-like wedge-shape member 62. The bucket member 62 includes a bottom wall 64, parallel side walls 66, 68 which are located at the left and right side of the bottom wall 64 and a periphery arc-shaped wall 69 which is located between the side walls 66 and 68. The arc preferably has its radius coincident with the shaft 72.

Bucket member 62 is mounted to pivot on a shaft 72 which is located at the base of side walls 66, 68 and in the preferred first embodiment is located at middle wall section 54.

Bucket member 62 is pivotally fitted in a rectangular attaching opening 74 in middle wall section 54. Periphery wall 69 is arc-shaped with a radius center at shaft 72. Bucket member 62 can be selectively moved by an actuator unit to a coin storing position 74 which is a solid line in FIG. 2 and a coin release section 76 which is the dotted line in FIG. 2.

Therefore, at the storing position 74, the moving wall section 60 is in a situation where coins 36 contacting the moving wall section 60 do not slide towards the rotating coin selector disk 16. In other words, as shown in FIG. 2, the moving wall section 60 slants parallel to the rotating coin selector disk 16. It is desirable that the moving wall section 60 slants more than the tilt of the rotating coin selector disk 16 to further increase the storage capacity and to occupy a greater portion of the exterior adjacent space that is not otherwise used.

At the coin release position 76, moving wall section 60 slants downward towards the rotating coin selector disk 16 and coins 36 on the moving wall section 60 can slide towards the rotating coin selector disk 16.

Next, an actuator unit 70 which can move moving wall section 60, as shown in FIG. 2, is described. In this embodiment, actuator 70 is a screw jack unit 71. Stationary section 72 includes a worm gear and a worm wheel and pivots on shaft 75 which is fixed at the upper surface of base 14. Electrical motor 73 with a reducer unit is fixed at stationary section 72 and drives the worm gear (not shown).

Moving section 77 is inserted into stationary section 72 and can move into or out of the stationary section 72 depending on the rotating direction of the worm wheel (not shown). The end of moving section 77 can pivot on shaft 79 which is fixed at moving wall section 60. When screw jack 71 is shortened, moving wall section 60 is located at a coin storing position 74. When screw jack 74 is lengthened, moving wall 60 is located at a coin releasing position 74.

Actuator unit 70 can be an air-cylinder, an oil-cylinder, a linear motor, etc., or even a compression spring unit In other words, actuator 70 has a function that can selectively move moving wall section 60 to a coin storing position 74 or a coin release section 76. When the coins stored in storing bowl 20 become a predetermined amount, actuator 70 is automatically operated. In other words, when the coins 36 on above rotating coin selector disk 16 are not detected by a coin amount detecting unit 80, actuator 70 is operated to release the stored coins in the bucket member 62. Coin amount detecting unit 80 includes a first electrode 82 and a second electrode 84 which are positioned in middle wall surface 54 at a predetermined distance above the outlet 50 of storing bowl 20.

Figure 4:
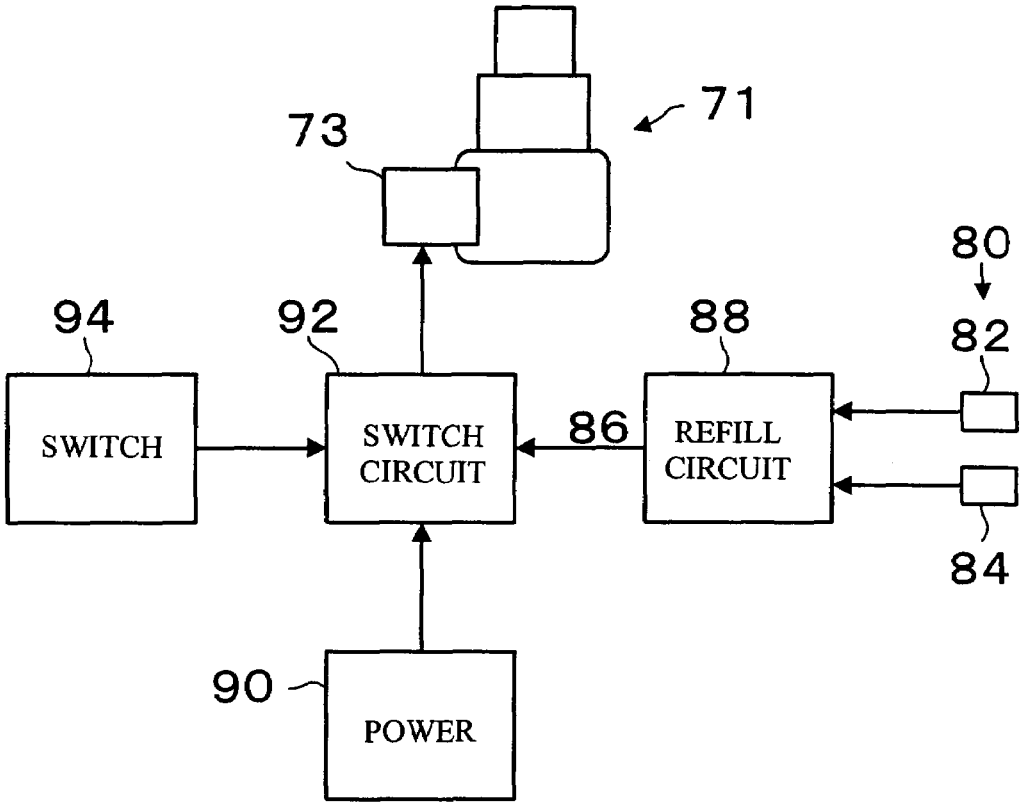
FIG. 4 is a schematic block diagram showing a controlling circuit for the first embodiment.

When the amount of coins above the rotating coin selector disk 16 is reduced to a predetermined amount, the current flow across the contacting coins in the storing bowl 20 between the first electrode 82 and second electrode 84 is broken. Therefore, a refilling signal 86 is outputted by a refilling direction circuit 88 connected to the electrodes as shown in FIG. 4.

Refilling direction circuit 88 opens and shuts a switching circuit 92 which is located between a power source 90 and the electric motor 73. When switching circuit 92 receives the coin refilling signal 86, power source 90 and electric motor 73 are connected. Therefore, electric motor 73 rotates in a predetermined direction, and screw jack 71 is extended. As a result, moving wall section 60 is moved to a coin releasing position 76.

When moving wall section 60 moves to the coin releasing position 76, it is detected by a sensor (not shown) and switching circuit 92 becomes "OFF" and electric motor 73 stops. Coin amount detecting unit 80 can be changed to a photoelectric sensor, optical sensor or other form of sensor. Also, before the initial operation, electric motor 73 is rotated in the counter direction by a manual switch 94. Therefore, screw jack 71 is retracted, and moving wall section 60 is returned to the coin storing position 74.

When moving wall section 60 returns to the coin storing position 74, a sensor (not shown) detects it, and switching circuit 92 becomes "OFF", and electric motor 73 stops. Manual switching 94 can be changed to a second coin amount detecting sensor. Therefore, when the coins above rotating coin selector disk 16 reach a predetermined amount, motor 73 is rotated in a counter direction, and moving wall section 60 is automatically returned to the coin storing position 74.

The operation of the first embodiment of the invention is explained. First, manual switch 94 is pushed, and moving wall section 60 is kept in a coin storing position 74. Before the operation starts, coin storing bowl 20 is filled by coins 36 through the opening 46. Therefore, coins 36 are also stored in the auxiliary volume 96 of bucket 62.

If used in a casino, when a customer wins a game, a predetermined amount of coins are dispensed one by one from a throwing coin exit 98 by the rotating coin selector disk 16. When the coins 36 are above a predetermined amount of coins in the hopper 10, an electric current can flow through the coins between the first electrode 82 and the second electrode 84, and refilling direction circuit 88 does not output a refilling signal. Therefore, moving wall section 60 is kept in a coin storing position 74.

When the coins 36 reach the predetermined amount, the current does not flow between first electrode 82 and second electrode 84, and refilling detecting circuit 88 outputs a refill signal 86 as shown in FIG. 4. Switching circuit 92 becomes "ON" by refilling signal 86, and motor 73 is rotated. Therefore, screw jack 71 becomes lengthened, and moving wall section 60 is moved to a coin release position 76. At the same time, coins 36 which are stored in volume 96 do not have contact with the fixed wall section. Therefore, the coins are not nipped between the moving wall section 60 and the fixed wall section. As a result, bucket member 62 is not stopped or interfered with.

Therefore, the stored coins 36 will slide on moving wall section 60 towards the rotating coin selector disk 16, and are dispensed above the rotating coin selector disk 16. Accordingly, the number of coins 36 are increased in the storing bowl 20, and operator refilling work is reduced. Also, when a prior art coin hopper is converted, the old storing bowl is changed to the present invention's storing bowl 20 which includes moving wall section 60 and adds the actuator 70 and the controlling circuit. As a result, the retro-conversion can be inexpensive and easy to install.

Figure 5:
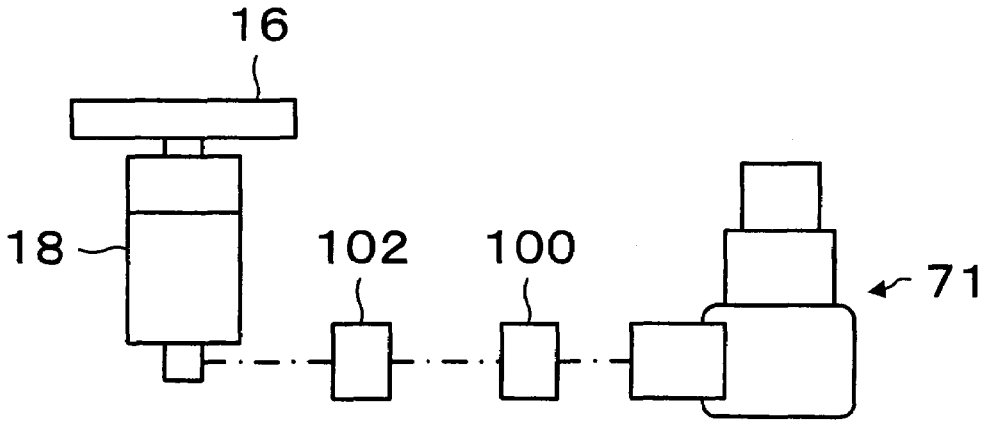
FIG. 5 is a schematic illustration of a driving system diagram for a second embodiment of the present invention.

Next, a second embodiment of the present invention is explained as shown in FIG. 5. In the second embodiment, the previously described electrical motor 73 for screw jack 71 is not used, and screw jack 71 is extended by the drive electrical motor 18 for the rotating coin selector disk 16.

One-way clutch 102 is located on a power transmitting system between the outputting shaft of motor 18 and second reducer unit 100. Second reducer unit 100 and the worm gear of screw jack 71 are operatively connected. When the output shaft of motor 18 rotates in a predetermined direction, the one-way clutch 102 releases and does not transmit any power. When the output shaft of motor 18 rotates in an opposite direction, the one-way clutch 102 engages and drives the worm gear of screw jack 71 through a second reducer unit 100.

Therefore, when the coin amount detecting unit 80 does not detect an electric current flow through conductive coins, the motor 18 automatically stops, and afterwards rotates in the counter direction. By this counter rotation, screw jack 71 is driven through the one-way clutch 102 and second reducer unit 100. Therefore, moving wall section 60 is moved to a coin release position 76. In this embodiment, as in a start position, moving wall section 60 is returned to a coin storing position 74 by motor 18 without use of the one-way clutch 102. Also, if during the movement of the moving wall section 60, a coin dispensing signal is received, the dispensing signal is stored and afterwards the coins are dispensed based on the stored dispensing signal.

Figure 6:
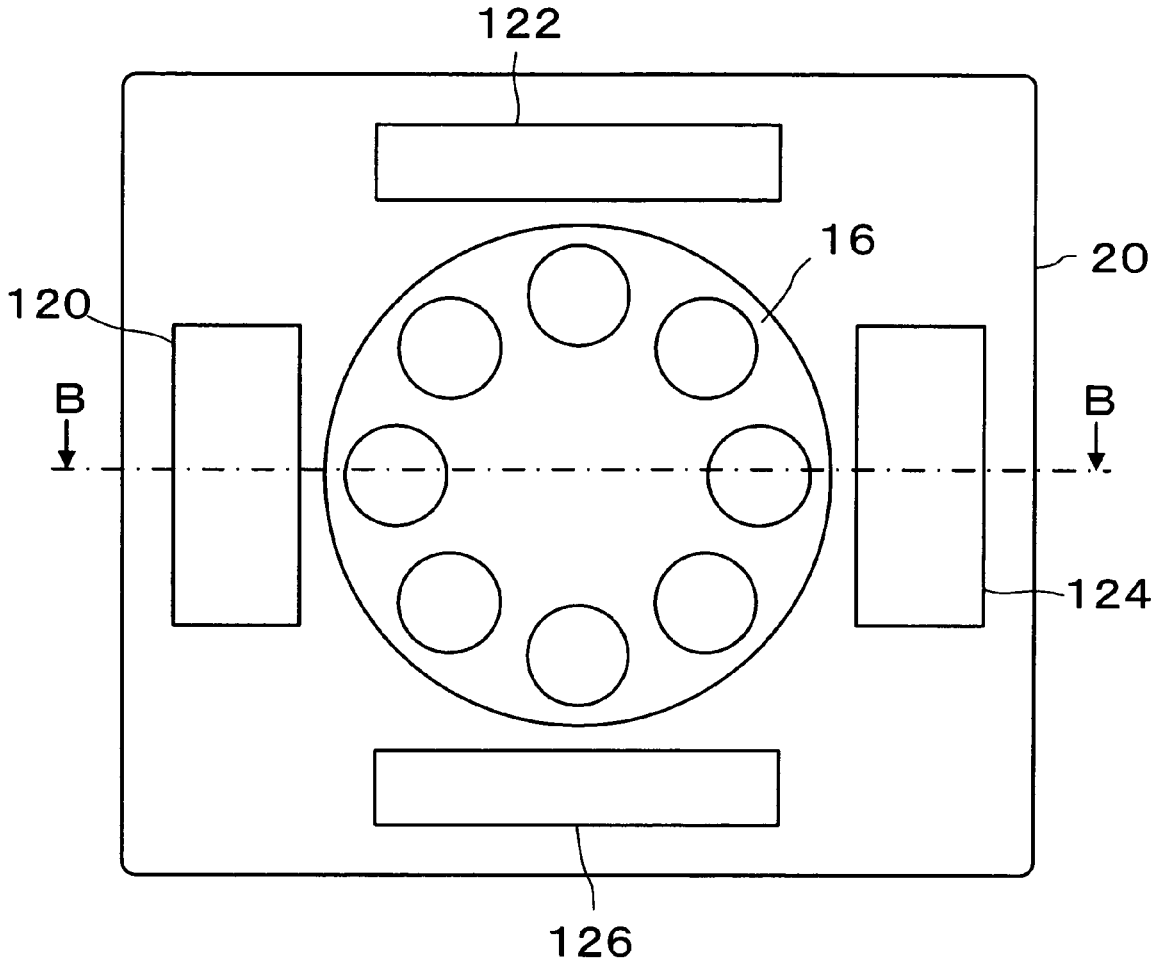
FIG. 6 is a schematic plan view illustrating a third embodiment of the present invention.
Figure 7:
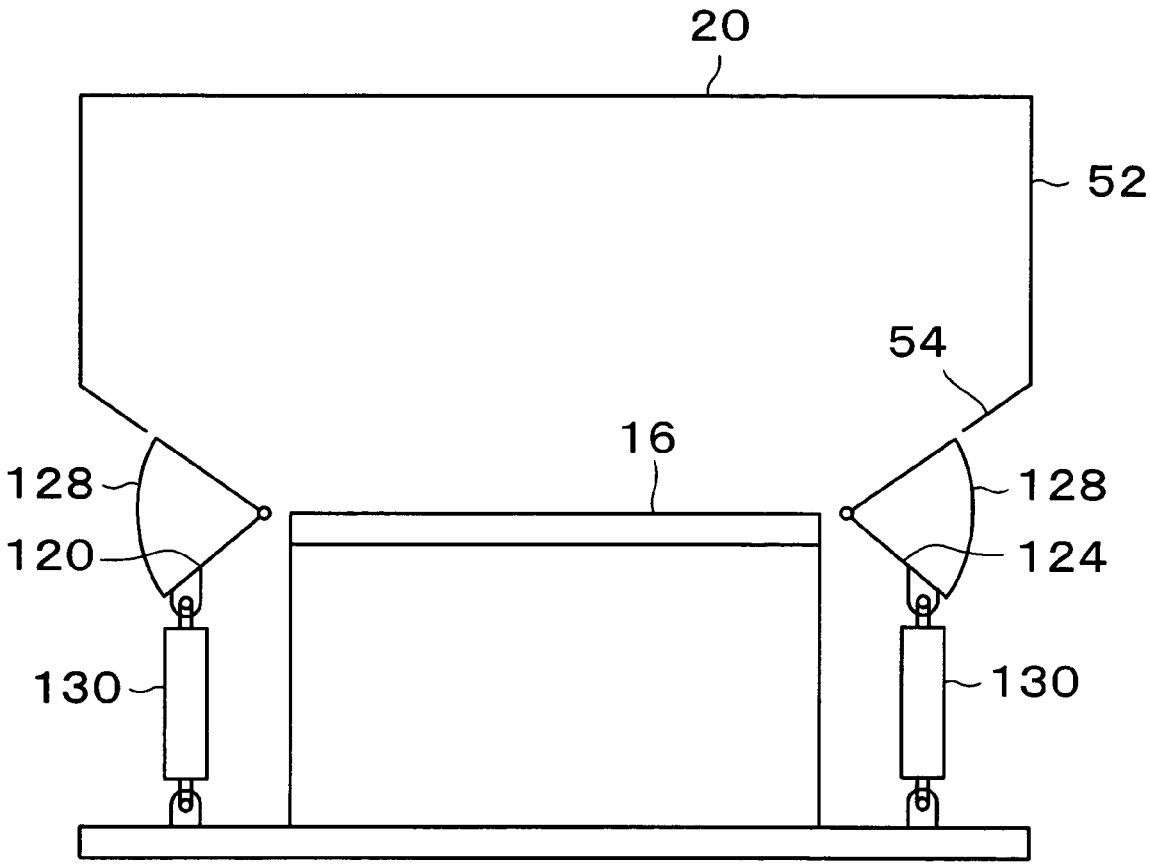
FIG. 7 is a schematic cross-sectional view taken along the plane B-B of FIG. 6.

Next, a third embodiment of the present invention is explained by referring to FIGS. 6 and 7. In the third embodiment, rotating coin selector disk 16 is located in a horizontal position, and four separate moving wall sections 120, 122, 124, 126 are also located around the rotating coin selector disk 16. As shown in FIG. 7, moving wall sections 120, 122, 124, 126 are configured in a bucket shape 128 as in the first embodiment although other configurations could be used. Buckets 128 are moved between coin storing positions and the coin releasing positions by actuators 130. The operation is the same as in the first embodiment. In the first embodiment and third embodiment, the moving wall sections are located at the middle wall section 54; however, they can be located at a perpendicular section 52.

Figure 8:
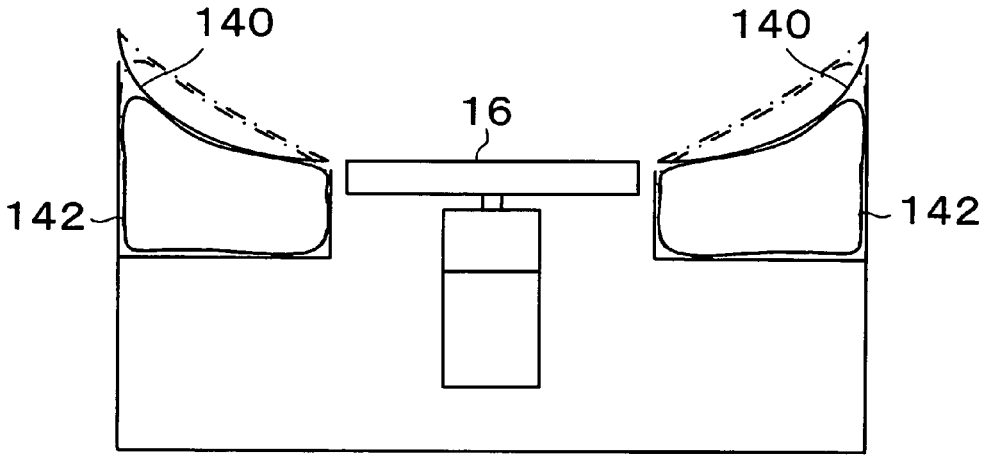
FIG. 8 is a schematic embodiment for disclosing the advantages of a fourth embodiment of the present invention.

Next, a fourth embodiment of the present invention is explained by referring to FIG. 8. In this embodiment, moving wall section 40 has a concave shape, and at the coin release position, it is moved to a straight slanted position as shown in the depicted imaginary line. In this embodiment, moving wall section 140 is made up of an elastic material and can be located around the rotating coin selector disk 16. Also, actuator unit 142 can be made up of an elastic expandable tube which has an annular ring shape and compressed air from a pump (not shown) can drive the moving wall section 140 to a coin release position. Release of the air pressure permits a return to a coin storage position. A concave support structure (not shown) can be mounted in the elastic tube to have a default coin support position.

Figure 9:
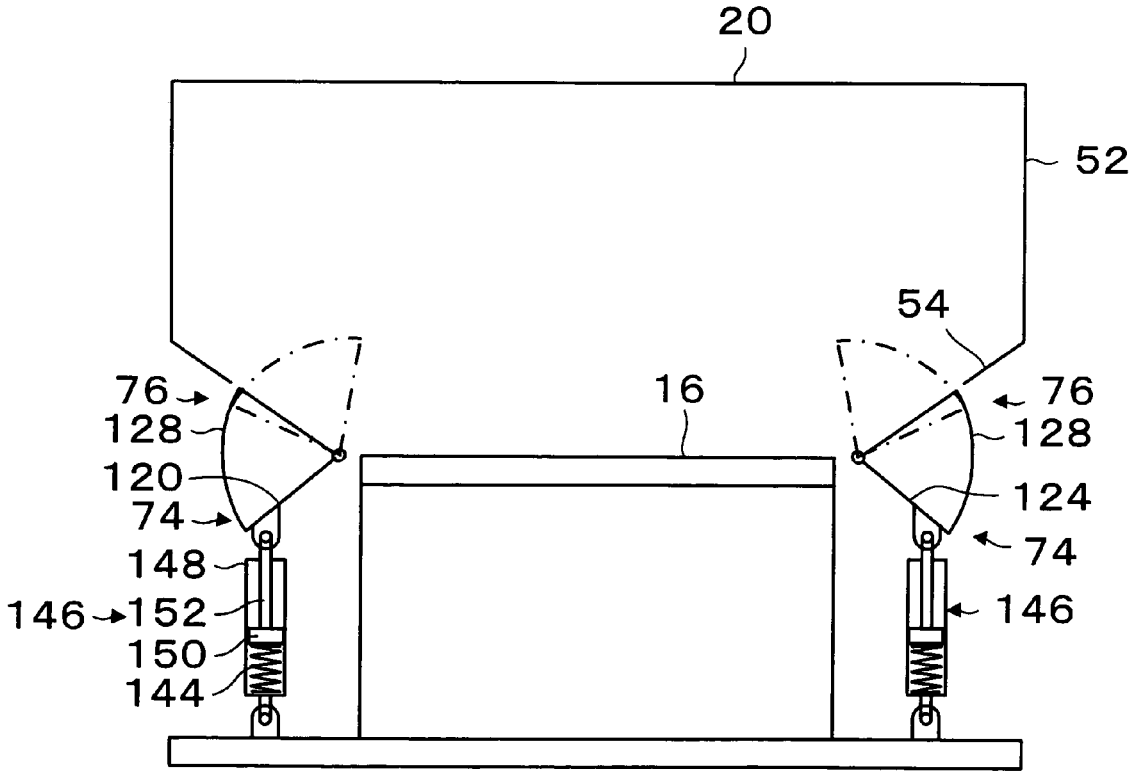
FIG. 9 is a schematic cross-sectional view for purposes of explaining the fifth embodiment of the present invention.

Next, a fifth embodiment of the present invention is explained by referring to FIG. 9. In this embodiment, the actuator unit 130 in the third embodiment can be replaced with another actuator unit 146 which has a built-in spring 144. Actuator 146 includes a rod 152 which is attached to a slidable piston 150 by the spring 144 in cylinder housing 148. Bucket members 128 are lifted up by the rods 152, and the respective moving wall sections 120, 122, 124, 126 are moved from the coin storing positions 74 to coin release positions 76.

Moving wall sections 120, 122, 124, 126 can be moved between coin storing positions 74 and coin release positions 76 based on the weight of coins 36. In other words, when the storing bowl 20 is full, many coins 36 are located above the moving wall sections 120, 122, 124, 126. Therefore, bucket members 128 pivot downward by the weight of the coins 36 whish is greater than the force of spring 144, and move to coin storing positions 74 which is a solid line.

When coins 36 in storing bowl 20 are reduced below a predetermined number to remove their weight above the bucket members, the bucket members 128 are pivoted upwards by the spring 144. Therefore, moving wall sections 120, 122, 124, 126 move to a coin release section 76, and coins 36 in each bucket 128 are provided onto rotating coin selector disk 16.

Also, when moving wall sections 120, 122, 124, 126 are moved by only the spring 144, the coins 36 are thrown outward into storing bowl 20. A buffering unit (not shown) can be attached to rod 152 to limit its acceleration. Accordingly, moving wall sections 120, 122, 124, 126 are moved slowly and the coins are released in a controlled fashion.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin hopper comprised of:

a storing bowl for storing coins in bulk within an interior wall surface which includes a movable wall section for selectively extending radially outward to increase an interior volume of the storing bowl for holding additional coins in the storing bowl when in a coin storing position mode;

a rotating coin selector disk is operatively connected to the storing bowl;

the movable wall section provides the operative coin storing position mode and a coin release position mode, the movable wall section includes a bottom wall for supporting coins, a pair of parallel side walls and a periphery wall extending between the parallel side walls and the bottom wall;

the coins contacting the movable wall section slide away from the rotating coin selection disk in the coin storing position mode, and the coins slide towards the rotating coin selector disk in the coin release position mode, wherein the total interior volume is made smaller in the coin release position mode.

2. The coin hopper of claim 1, wherein the movable wall section is located adjacent the rotating coin selector disk.

3. The coin hopper of claim 2, wherein the movable wall section forms a portion of a perimeter wall of the storing bowl.

4. The coin hopper of claim 1 wherein the movable wall section has a bucket configuration.

5. The coin hopper of claim 2 wherein the movable wall section is pivotally mounted as a portion of the storing bowl, with the pivoting axis being at a closest portion of the movable wall section to the rotating coin selector disk.

6. A coin hopper comprised of:

a storing bowl for storing coins in bulk and includes a wall section that slants downward to enable a gravity feed of coins;

a rotating coin selector disk which is located adjacent a bottom of the storing bowl for selectively releasing coins;

a movable wall section is connected to and forms an extension of the wall section of the storing bowl to provide one of a coin storing position by increasing a volume of the storing bowl and a coin release position by decreasing a volume of the storing bowl, the coins contacting the movable wall section slide away from the rotating coin selector disk in the coin storing position, however, the coins slide towards the rotating coin selector disk in the coin release position;

a coin amount detecting unit which detects a predetermined amount of coins above the rotating coin selector disk and outputs a refilling signal upon detecting the predetermined amount of coins; and an actuator unit which operates the movable wall section to move from the coin storing position to the coin release position and reduces an interior coin storage volume of the coin hopper based on the refilling signal.

7. The coin hopper of claim 6, wherein the rotating coin selector disk is driven by an electric motor, when the electric motor rotates in a first direction, the rotating coin selector disk selectively releases coins and when the motor rotates in a second counter direction, the actuator unit is driven and the moving wall section moves from the coin storing position to the coin release position.

8. In a coin dispensing apparatus for providing stored coins to a coin selector unit for dispensing coins, the improvement comprising:

a storage member for storing coins;

a movable member is pivotably connected to a wall of the storage member for selectively increasing the coin storage volume of the storage member when the movable member is extended in a first direction to receive coins in an extended storage volume and releasing the stored coins in a contracted storage volume when the movable member is contracted in a second direction to enable coins to be released to the coin selection unit, coins contacting the movable member slide away from the coin selection unit in the first direction.

9. The coin dispensing apparatus of claim 8 further including an actuator unit for driving the movable member from a coin storage position to a coin release position.

10. The coin dispensing apparatus of claim 9 wherein the actuator unit includes a screw jack member that can linearly extend and contract.

11. The coin dispensing apparatus of claim 9 where the actuator unit is a spring member.

12. The coin dispensing apparatus of claim 9 further including a detector unit for monitoring the amount of coins in the storage member to activate the actuator unit.

13. The coin dispensing apparatus of claim 8 wherein the movable member is a wedge-shaped bucket member.

14. A storage member for a coin dispensing apparatus to store coins and dispense coins, comprising:

a housing member having a cavity for storing coins when mounted in a coin dispensing apparatus;

a movable member pivotably connected to a wall of the cavity of the housing member for increasing and decreasing the storage volume available for coins in the housing member, the coins contacting the movable member slide away from a coin dispensing location when the storage volume is increased; and an actuator unit for driving the movable member from a coin storage position to a coin release position.

15. The storage member of claim 14 wherein the actuator unit includes a screw jack member that can linearly extend and contract.

16. The storage member of claim 14 where the actuator unit is a spring member.

17. The storage member of claim 14 further including a detector unit for monitoring the amount of coins in the storage member to activate the actuator unit.

18. The storage member of claim 14 wherein the movable member is a wedge-shaped bucket member.

19. A coin hopper comprising:

a storing bowl for storing coins in bulk including an interior wall section that slants downward and toward a rotating coin selection disk to gravity feed the coins, the rotating coin selection disk is located adjacent a bottom of the storing bowl for selectively releasing coins;

a moving wall section includes a movable member which is pivotably connected to the interior wall section of the storing bowl to provide both a coin storing position and a coin release position, one end of the movable member is pivotably connected to the interior wall section and a far end of the movable member can move to a lower position than the pivoted connection, the coins contacting the moving wall section slide away from the rotating coin selector disk in the coin storing position, however, coins slide towards the rotating coin selection disk in the coin release position;

a coin amount detecting unit which detects a predetermined amount of coins above the rotating coin selector disk and outputs a refilling signal upon detecting the predetermined amount of coins; and an actuator unit which operates the moving wall section to move from the coin storing position to the coin release position based on the refilling signal.

20. A coin hopper comprising:

a storing bowl for storing coins in bulk within an interior wall surface which includes a movable wall section for selectively extending radially outward to increase an interior volume of the storing bowl for holding additional coins in the storing bowl when in a coin storing position mode;

a rotating coin selector disk is operatively connected to the storing bowl;

the movable wall section provides the operative coin storing position mode and a coin release position mode, the movable wall section is elastic and extends around the rotatable coin selector disk; and means for inflating and deflating the movable wall section to decrease and increase the interior volume of the storing bowl, wherein the coins contacting the movable wall section slide away from the rotating coin selector disk in the coin storing position mode, however, coins slide towards the rotating coin selector disk in the coin release position mode, wherein the total interior volume is made smaller in the coin release position mode.

* * * * *